US007308989B2

(12) United States Patent
Zheng

(10) Patent No.: US 7,308,989 B2
(45) **Date of Patent: *Dec. 18, 2007**

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 716 days.

This patent is subject to a terminal disclaimer.

(21) Appl. No.: 10/665,194

(22) Filed: Sep. 17, 2003

(65) Prior Publication Data

US 2004/0139996 A1 Jul. 22, 2004

Related U.S. Application Data

(63) Continuation-in-part of application No. 10/346,832, filed on Jan. 17, 2003, now Pat. No. 6,901,940.

(51) Int. Cl.
*E04H 4/00* (2006.01)

(52) U.S. Cl. ..... 220/9.2; 220/565; 220/666; 4/488; 4/585; 4/588; 4/506; 383/33; 383/104

(58) Field of Classification Search ..... 220/4.16, 220/4.29, 9.2; 4/506, 585, 587, 588; 383/104
See application file for complete search history.

(56) References Cited

U.S. PATENT DOCUMENTS 618,442 A * 1/1899 Shearer ..... 220/9.2
1,075,912 A * 10/1913 Helli ..... 4/587
1,130,777 A * 3/1915 Ward ..... 4/587
1,961,061 A * 5/1934 McCulloch ..... 52/2.21
2,150,620 A * 3/1939 Frost ..... 220/9.2
2,505,845 A * 5/1950 Alvarez ..... 4/588
2,714,726 A * 8/1955 Hasselquist ..... 4/506
2,754,869 A * 7/1956 Bartels ..... 383/12
2,854,049 A * 9/1958 Wyllie ..... 220/565
4,383,564 A * 5/1983 Hoie ..... 383/66
4,576,375 A 3/1986 Roberts
4,900,011 A * 2/1990 Nolet ..... 482/29
4,951,333 A 8/1990 Kaiser et al.
5,116,138 A * 5/1992 Macsenti et al. ..... 383/33
5,163,461 A 11/1992 Ivanovich et al.
5,301,705 A * 4/1994 Zheng ..... 135/126
5,314,250 A * 5/1994 Lee ..... 383/3
5,429,437 A 7/1995 Shaw
5,560,385 A * 10/1996 Zheng ..... 135/125
5,603,129 A * 2/1997 Chou ..... 4/506
5,618,246 A 4/1997 Zheng
5,967,357 A * 10/1999 Kellogg et al. ..... 220/9.2
5,971,188 A * 10/1999 Kellogg et al. ..... 220/9.2
5,975,101 A * 11/1999 Zheng ..... 135/125
6,019,244 A * 2/2000 Jones ..... 220/666
6,030,300 A 2/2000 Zheng (Continued)

*Primary Examiner*—Robert Canfield
(74) *Attorney, Agent, or Firm*—Raymond Sun

(57) ABSTRACT

Collapsible structures are provided that have an enclosed interior space that can be used to hold and contain water or other matter. The interior space is defined by an enclosing wall and a base that are both waterproof to prevent leakage of the water or matter contained in the interior space. None, one or more foldable frame members can be provided as part of the enclosing wall and the base, or a foldable frame member can be provided as part of a rim member. The frame members allow the resulting structure to be twisted and folded to reduce the overall size of the structure.

6 Claims, 7 Drawing Sheets

U.S. PATENT DOCUMENTS 6,058,521 A * 5/2000 O'Brien ..... 4/492
6,073,283 A 6/2000 Zheng
6,170,100 B1 1/2001 Le Gette et al.
6,192,635 B1 2/2001 Zheng
6,220,998 B1 * 4/2001 Kellogg et al. ..... 493/218
6,267,129 B1 * 7/2001 Zheng ..... 135/126
6,289,910 B1 9/2001 Zheng
6,305,396 B1 * 10/2001 Zheng ..... 135/126
6,318,394 B1 * 11/2001 Zheng ..... 135/126
6,343,391 B1 2/2002 Le Gette et al.
6,485,344 B2 11/2002 Arias
RE37,924 E * 12/2002 Kellogg et al. ..... 220/9.2
6,783,016 B2 * 8/2004 Wang ..... 220/9.2
6,901,940 B2 * 6/2005 Zheng ..... 135/126
7,156,250 B2 * 1/2007 Tillmann et al. ..... 220/9.2
2004/0089660 A1 * 5/2004 Zaytoune ..... 220/9.2
2006/0186119 A1 * 8/2006 Zheng ..... 220/9.2

* cited by examiner 72
70
74
76
78

60
28
36
26
30
34
20
2
2
32
46
10
38
B
22
58
24

COLLAPSIBLE STRUCTURES

RELATED CASES

This is a continuation-in-part of Ser. No. 10/346,832, filed Jan. 17, 2003 now U.S. Pat. No. 6,901,940, entitled "Collapsible Structures", whose entire disclosure is incorporated by this reference as though set forth fully herein.

BACKGROUND OF THE INVENTION

1. Field of the Invention

The present invention relates to collapsible structures, and in particular, to collapsible structures which are adapted to hold and contain water, and which may be twisted and folded to reduce the overall size of the assembly to facilitate convenient storage and use.

2. Description of the Prior Art

Collapsible objects have recently become popular with both adults and children. Examples of such collapsible objects are shown and described in U.S. Pat. No. 5,038,812 (Norman), U.S. Pat. No. 5,467,794 (Zheng) and U.S. Pat. No. 6,390,111 (Zheng) in the form of collapsible structures. These structures can be used as play structures, shelters, tents, and storage structures, among other uses. These structures may be twisted and folded to reduce the overall size of the structures to facilitate convenient storage and use. As such, these structures are being enjoyed by many people in many different applications.

Other examples of collapsible objects include blanket, mat and floating assemblies as illustrated in one or more of U.S. Pat. No. 6,073,283 (Zheng), U.S. Pat. No. 6,170,100 (Le Gette et al.), U.S. Pat. No. 6,343,391 (Le Gette et al.) and U.S. Pat. No. 6,485,344 (Arias). These assemblies can be used as blankets, floor mats, and floating loungers. These blankets, mats and loungers may be twisted and folded to reduce the overall size of the blanket or mat to facilitate convenient storage and use.

SUMMARY OF THE INVENTION

It is an object of the present invention to provide a collapsible structure that can hold and contain matter without leakage of the contained matter.

It is another object the present invention to provide a collapsible and waterproof structure that can hold and contain water without leakage thereof.

The objectives of the present invention can be accomplished by providing, in one embodiment, a collapsible structure having at least three foldable frame members, each having a folded and an unfolded orientation, and a waterproof sheet material covering each frame member to form a panel for each frame member. The panels are coupled to each other to form a ring of panels that defines an interior space, and the structure also includes a waterproof bottom panel attached to the bottom of each panel in a manner such that the interior space is waterproof.

According to another embodiment of the present invention, a collapsible structure has a foldable frame member having a folded and an unfolded orientation, a waterproof sheet material covering the frame member to form a bottom panel, and a waterproof enclosing wall that defines an interior space, the enclosing wall having a bottom edge that is attached to the periphery of the bottom panel in a manner such that the interior space is waterproof.

According to yet another embodiment of the present invention, a collapsible structure has first and second flexible frame members, each frame member defining a closed loop and having a first side and an opposing second side, each frame member adapted to assume an expanded position and a collapsed position, with the two frame members overlapping each other at a first overlapping point along the first sides of the frame members, and at a second overlapping point along the second sides of the frame members. The frame members are adapted to assume a deployed position in which one frame member is disposed at an angle with respect to the other frame member at the overlapping points, so that the structure defines a top side and a bottom side when the frame members are in the deployed position. The structure also includes a waterproof enclosing wall extending about the two frame members and the bottom side to define a waterproof interior space.

According to yet a further embodiment of the present invention, a collapsible structure has an annular rim member defining a central opening, with the rim member including a foldable frame member having a folded and an unfolded orientation. The structure also has a flexible and waterproof material attached to the rim member to form a containing member that defines a containing space therewithin, the containing member having a base that has a diameter that is greater than the diameter of the rim member when the containing space is filled with a liquid.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible structures that have an enclosed interior space that can be used to hold and contain water or other viscuous and non-viscuous matter. The interior space is defined by an enclosing wall and a base that are both waterproof to prevent leakage of the water or matter contained in the interior space. None, one or more foldable frame members can be provided as part of the enclosing wall and the base. The frame members allow the resulting structure to be twisted and folded to reduce the overall size of the structure.

Figure 1A:
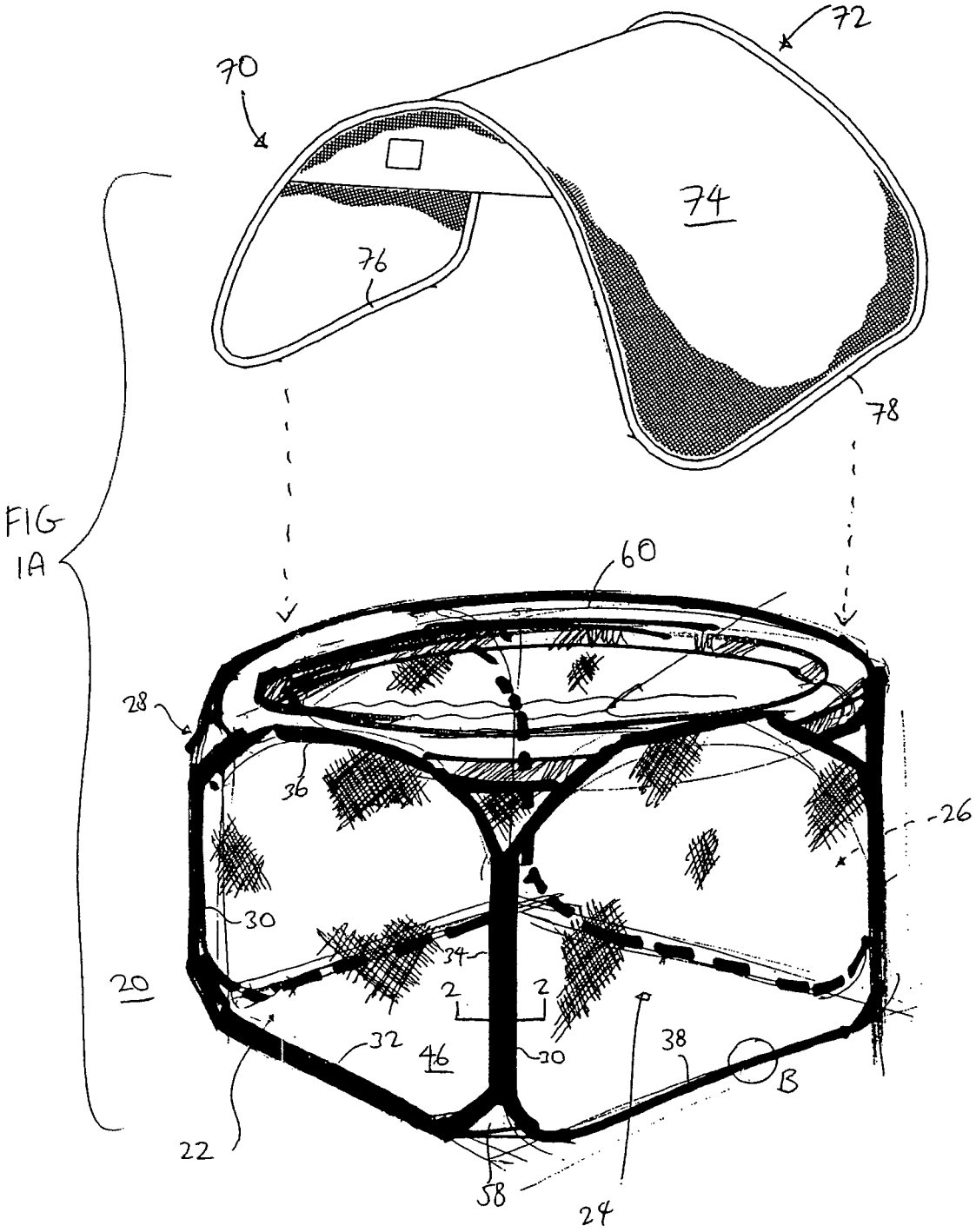
FIG. 1A is a perspective view of a collapsible structure according to one embodiment of the present invention.

FIG. 1A illustrates a collapsible structure 20 that is made up of a plurality of panels that are hingedly coupled together. The structure 20 has four side panels 22, 24, 26 and 28 hingedly connected to each other to form a ring of panels that encircle an enclosed space. Each panel 22, 24, 26, 28 has four sides, a left side 30, a bottom side 32, a right side 34 and a top side 36. The left side 30 of each panel 22, 24, 26, 28 is hingedly coupled to the right side 32 of an adjacent panel 22, 24, 26, 28 to encircle the enclosed space.

Even though each panel 22, 24, 26, 28 is illustrated as having four sides, it is possible to configure any of these panels 22, 24, 26, 28 with any shape having different number of sides, including sides that have varying degrees of curvature. For purposes of the present invention, a "side" can have varying degrees of curvature and is not restricted to merely a straight configuration. As a result, each side 30, 32, 34 can be partially or completely curved.

Figure 1B:
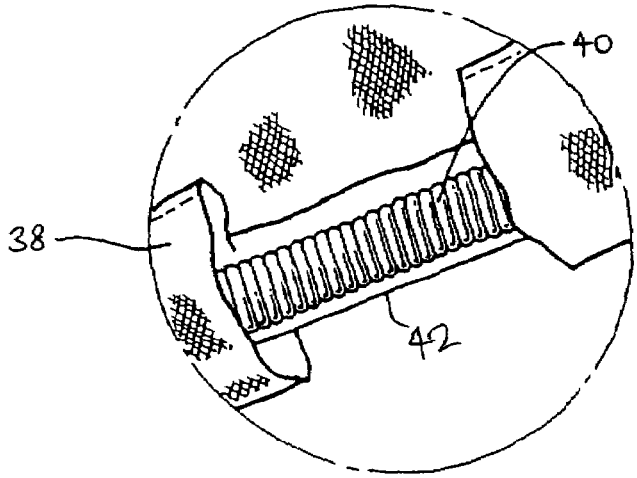
FIG. 1B is a partial cut-away view of the section B of the structure of FIG. 1A illustrating a frame member retained within a sleeve.

Referring to FIG. 1B, each panel 22, 24, 26, 28 has a continuous frame retaining sleeve 38 provided along and traversing the edges of its sides 30, 32, 34, 36. A continuous frame member 40 is retained or held within each frame retaining sleeve 38 to support each panel 22, 24, 26 and 28. Only the frame member 40 for panel 24 is shown in FIG. 1B; the other frame members 40 for the other panels 22, 26, 28 are not shown but are the same as frame member 40 in FIG. 1B. The continuous frame members 40 may be provided as one continuous loop, or may comprise a strip of material connected at both ends to form a continuous loop. The continuous frame members 40 are preferably formed of flexible coilable steel, although other materials such as plastics may also be used. The frame members 40 should be made of a material which is relatively strong and yet is flexible to a sufficient degree to allow it to be coiled. The material should have a memory that allows the frame members to spring back to the expanded position when unfolded from the folded position. Thus, each frame member 40 is capable of assuming two positions or orientations, an open or expanded position such as shown in FIG. 1A, or a folded position in which the frame member is collapsed into a size which is much smaller than its open position as shown in FIG. 3C.

In addition, a protective covering 42 can be provided to cover the frame member 40. The protective covering 42 can be the same as that which is described in U.S. Pat. No. 5,845,697 to Zheng, whose entire disclosure is incorporated by this reference as though set forth fully herein. The protective covering 42 can be effective in preventing the metallic frame member 40 from rust and damage due to possible exposure to water.

Sheet material 46 extends across each panel 22, 24, 26 and 28, and is held taut by the respective frame members 40 when in the open position. The term sheet material is to be given its broadest meaning and should be made from strong, lightweight materials and may include waterproof materials such as films, soft plastic, PVC, and nylons, and non-waterproof materials such as fabric material (e.g., mesh, woven fabrics, etc.), depending on the application for which the structure 20 is used. The sheet material should be flexible, and also durable to withstand the wear and tear associated with rough treatment by children or outdoor use. The frame members 40 may be merely retained within the respective frame retaining sleeves 38 without being connected thereto. Alternatively, the frame retaining sleeves 38 may be mechanically fastened, stitched, fused, or glued to the frame members 40 respectively, to retain them in position.

Figure 2A:
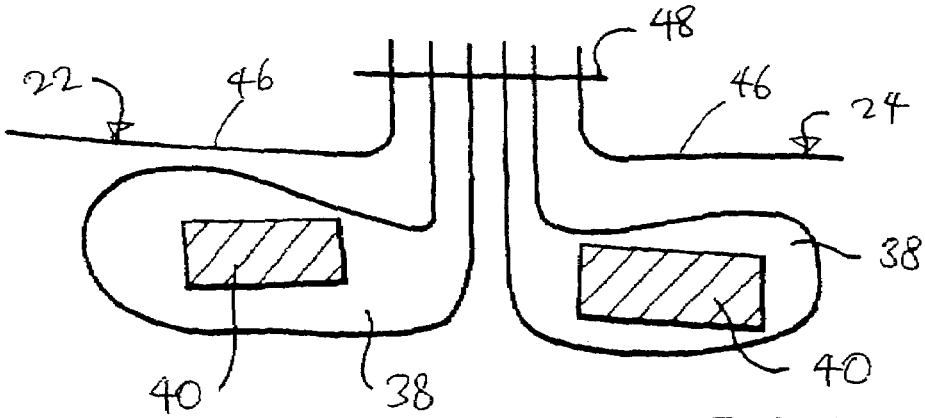
FIG. 2A is a cross-sectional view of a first preferred connection between two adjacent panels of the structure of FIG. 1 taken along line 2-2 thereof.

FIG. 2A illustrates one possible connection for connecting adjacent sides 30 and 34 of two panels 24 and 22, respectively, of FIG. 1A. The sheet material 46 for the two panels 22, 24 are stitched at their edges by a stitching 48 to the respective sleeves 38. Each sleeve 38 may be formed by folding a piece of sheet material or fabric. The stitching 48 also acts as a hinge for the panels 22 and 24 to be folded upon each other, as explained below. The connections for the three other pairs of adjacent edges may be identical. Thus, the connections on the left side 30 and the right side 34 of each panel 22, 24, 26 and 28 act as hinge connections for connecting an adjacent panel.

Figure 2B:
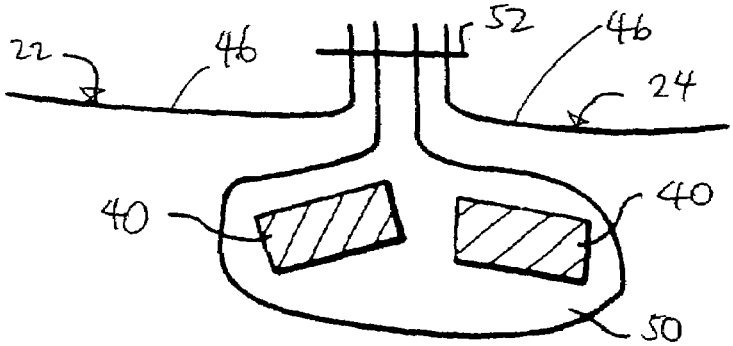
FIG. 2B is a cross-sectional view of a second preferred connection between two adjacent panels of the structure of FIG. 1 taken along line 2-2 thereof.

FIG. 2B illustrates a second possible connection for connecting adjacent sides 30 and 34 of two panels 24 and 22, respectively, of FIG. 1A. The fabric or sheet material 46 can be folded over at their edges at the bottom side 32 and the top side 36 to define the respective sleeves 38. However, the frame retaining sleeves 38 converge at, or are connected to, one sleeve portion which interconnects panels 22 and 24 to form a singular frame retaining sleeve 50 which retains the two frame members 40. Sleeve 50 of FIG. 2B may be formed by providing a tubular fabric or sheet material, or by folding a piece of fabric or sheet material, and applying a stitching 52 to its edges to connect the sleeve 50 to the fabric pieces 46 of the panels 22, 24. Stitching 52 acts as a hinge for the panels 22 and 24. The connections for the three other pairs of adjacent edges may be identical.

A bottom piece or floor 58 can be attached (e.g., by stitching, fusing, etc.) to the bottom sides 32 of the panels 22, 24, 26, 28. The bottom piece 58 can be made from the same flexible material as the sheet material 46.

In addition, an upper border 60 can be connected to the top sides 36 of the panels 22, 24, 26, 28 to provide a soft bordering edge that the user can rest on. The upper border 60 can assume any configuration (circular, square, rectangular, etc.) and defines an opening. In one embodiment, the upper border 60 can be a sleeve that houses a collapsible frame member which has the same construction as frame member 44. According to another embodiment, the upper border 60 can be an inflatable tube made from soft material.

While the structure 20 of FIG. 1A is shown and described as having four panels, each having four sides, it will be appreciated that a structure may be made of any number of panels, each having any number of sides, without departing from the spirit and scope of the present invention. Thus, the structure 20 of the present invention may take a variety of external shapes. However, each panel of the structure 20, regardless of its shape, is supported by at least one continuous frame member 40.

Figure 3A:
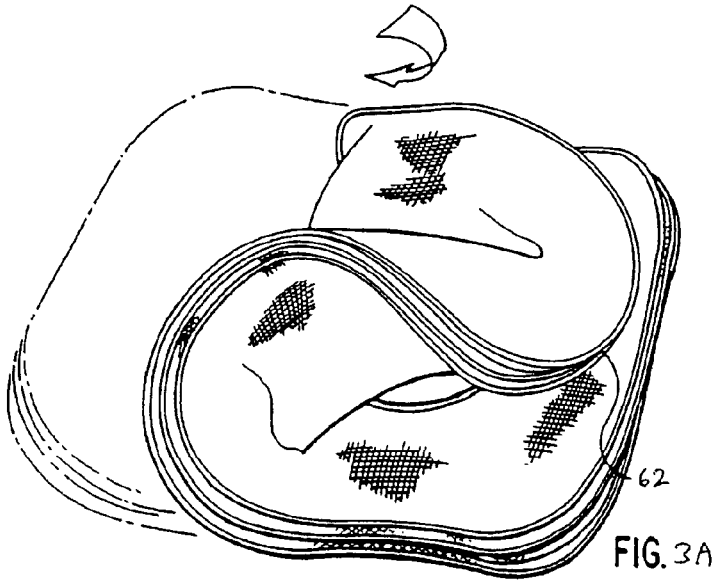
FIGS. 3A through 3C illustrate how the collapsible structure of FIG. 1A may be twisted and folded for compact storage.
Figure 3B:
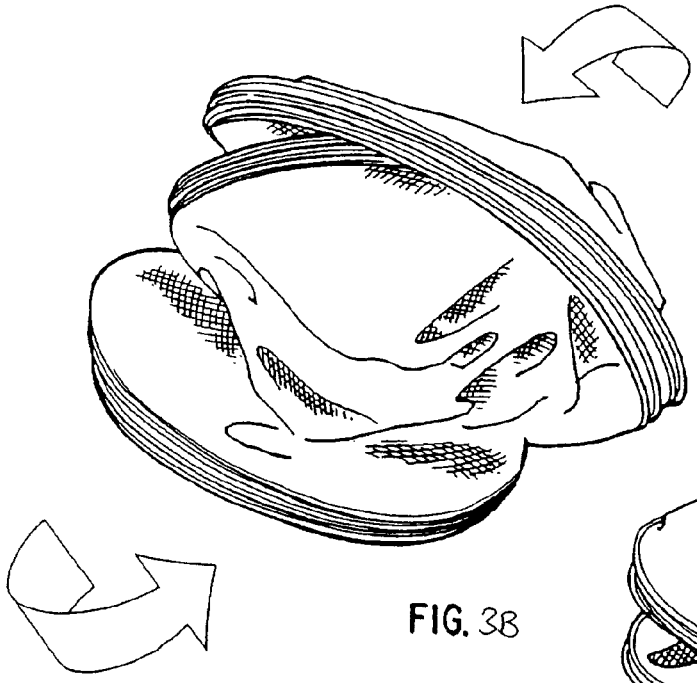
Figure 3C:
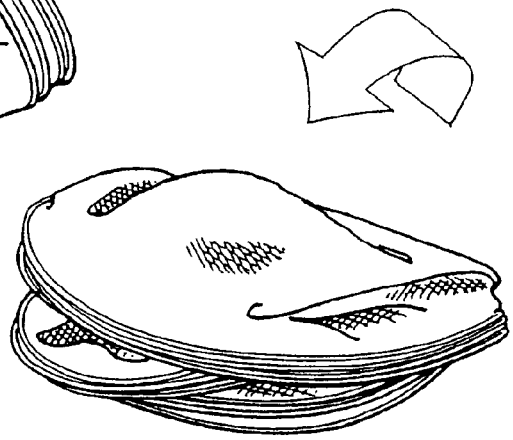

FIGS. 1A and 3A through 3C illustrate how the structure 20 of FIG. 1A can be twisted and folded to reduce the structure 20 into a collapsed configuration having a reduced size. The same principles can be applied to collapse all the other embodiments of the present invention. Referring to FIG. 1A, the first step consists of pushing in panels 22 and 24 such that panel 22 collapses upon panel 28, and panel 24 collapses upon panel 26. Then, in the second step, the two panels 24 and 26 are folded so as to be collapsed upon the two panels 22 and 28. The resulting structure 20 is now a stack of four panels 28, 22, 24, 26 (in one possible order) as shown in FIG. 3A, which is then twisted and folded to collapse the frame members and panels into a smaller shape. In the next step shown in FIG. 3A, the opposite border (designated by the numeral 62) of the structure 20 is folded in upon the previous fold to further collapse the frame members with the panels. As shown in FIG. 3B, the next step is to continue the collapsing so that the initial size of the structure 20 is reduced. FIG. 3C shows the frame members and panels collapsed on each other to provide for a small essentially compact configuration having a plurality of concentric frame members and layers of the panels so that the collapsed structure 20 has a size which is a fraction of the size of the initial structure 20. During the twisting and folding steps, the floor 58 can be tucked between any two adjacent panels, or on top of the stack of panels, to be twisted and folded together with the panels.

To re-open the structure 20 to its expanded configuration, the combined stack of panels is unfolded. The memory (i.e., spring-load) of the frame members 40 will cause the frame members to uncoil on their own and to quickly expand the panels to their expanded configuration shown in FIG. 1A. The same principle can be applied to re-open all the other embodiments of the present invention.

The structure 20 can be used as a wading pool, swimming pool, spa pool, or other pool or water tank that can hold water and, optionally, at least one occupant. When used for these purposes, the sheet materials 46 and 58 are preferably made of any of the waterproof materials described above. The height of the left side 30 and the right side 34 of the panels 22, 24, 26, 28 can be varied depending on the intended use. For example, the height of the sides 30, 34 can be greater when the structure 20 is used as a spa pool or swimming pool, and can be smaller when the structure 20 is used as a wading or play pool for children. The same principles are applicable to all the other embodiments illustrated herein.

The structure 20 can also be used as a pot or container or holding trees and plants. When used for these purposes, the sheet materials 46 and 58 can be made of a waterproof material, or a fabric material that allows water to seep therethrough for irrigation purposes.

Any number of different shade structures can be used with the structure 20 to shade the interior of the structure 20. FIG. 1A illustrates one embodiment of a shade structure 70 which can be provided for use with the structure 20. The shade structure 70 can be provided in the form of at least one panel 72 that has been arched or bent. The panel 72 can have the same construction as the panel 24 described herein, except that the sheet material 74 on the panel 72 can be provided in the form of fabric, nylon, mesh, or any similar material. The panel 72 has one frame member that defines two opposing side edges 76, 78, with each side edge 76, 78 being attached (e.g., by Velcro™ straps, hooks, ties or the like) to the top side 36 of one of two opposing panels 22 and 26, or 24 and 28. The panel 72 can function to shade the interior of the structure 20. For example, if the structure 20 is being used as a pool, the panel 72 can shade the occupants (especially children) of the pool from harmful sunlight.

The shade structure used with the structure 20 can also be embodied in many different configurations. For example, the collapsible structures illustrated in FIGS. 1, 5A, 6 and 7 of U.S. Pat. No. 6,289,910 to Zheng, FIGS. 1, 4, 5, 6, 7 and 8 of U.S. Pat. No. 6,360,761 to Zheng, FIGS. 1 and 12 of U.S. Pat. No. 5,301,705 to Zheng, FIGS. 11A, 14A and 20 of U.S. Pat. No. 6,138,701 to Zheng, FIGS. 27 and 28 of U.S. Pat. No. 6,449,147 to Zheng, FIGS. 1 and 5-10 of U.S. Pat. No. 6,453,923 to Zheng, FIGS. 1, 6 and 7 of U.S. Pat. No. 5,778,915 to Zheng, FIGS. 4A and 5A of U.S. Pat. No. 6,092,544 to Zheng, FIGS. 1A, 2A, 2B, 3A, 5A, 6A, 7A, 8A, 9, 10A, 11A, 12, 13, 14A, 15 and 16 of U.S. Pat. No. 6,098,349 to Zheng, FIG. 1A of U.S. Pat. No. 5,560,385 to Zheng, and FIGS. 4, 5, 7, 8, 9, 10-17, 23 and 24 of U.S. Pat. No. 6,082,386 to Zheng can all be permanently or removably attached to the structure 20, and the disclosures in each of these patents are hereby incorporated by this reference as though set forth fully herein.

Figure 4:
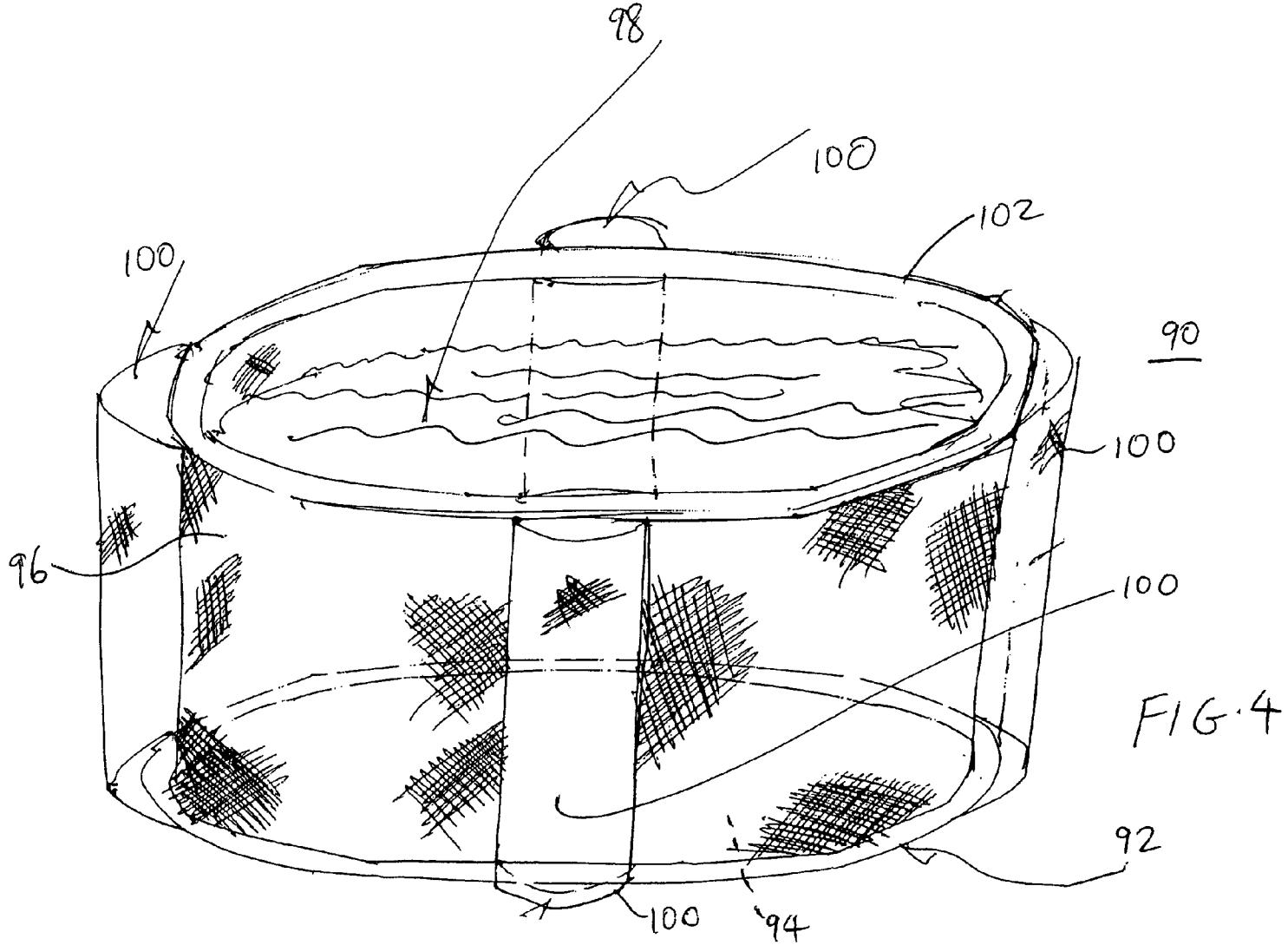
FIGS. 4-7 are perspective views of collapsible structures according to other embodiments of the present invention.

FIG. 4 illustrates a structure 90 that can also be used as a pool or container for holding water. The structure 90 has a base panel 92 that can have the same construction as the panel 24 described above, and having a frame member (not shown, but can be the same as 40) and sheet material 94 that is made of a waterproof and flexible material. The panel 92 can have any desired shape (e.g., circular, square, rectangular, etc.) and size. A vertical enclosing wall 96 is attached to the periphery of the base panel 92 and defines an interior space 98. The wall 96 can be made from a waterproof and flexible material. As an alternative, the wall 96 can be inflatable and made from a conventional two-layered material having an inflation chamber through which an inflation media (e.g., air or water) can be introduced to inflate the wall 96. A plurality of inflatable tubes 100 can be attached to the wall 96 and positioned in spaced-apart manner from each other. The tubes 100 can be made of a soft and flexible material. When the tubes 100 are inflated, they provide the necessary support to hold the wall 96 upright in the configuration shown in FIG. 4. If the wall 96 is itself inflatable, the tubes 100 can be omitted. In addition, an upper border 102 is provided along the top edge of the wall 96, and can be the same as the upper border 60, and embodied as a sleeve with a collapsible frame member, or as an inflatable tube.

To store the structure 90, the user can deflate the wall 96 (if the wall 96 is inflatable) and the tubes 100, and then the wall 96 and the tubes 100 can be compressed against the panel 92. The panel 92 can then be twisted and folded according to the steps shown in FIGS. 3A-3C to collapse the structure 90 into a smaller size for convenient storage.

The structure 90 in FIG. 4 can be modified by providing a collapsible frame member (such as frame member 40) as part of the upper border 102, and providing the panel 92 with merely the sheet material 94 and without any frame member. In such an embodiment, the user can deflate the wall 96 (if the wall 96 is inflatable) and the tubes 100, and then the sheet material 94, the wall 96 and the tubes 100 can be compressed against the upper border 102 and its frame member. The frame member in the upper border 102 can then be twisted and folded according to the steps shown in FIGS. 3A-3C to collapse the structure into a smaller size for convenient storage.

Figure 5:
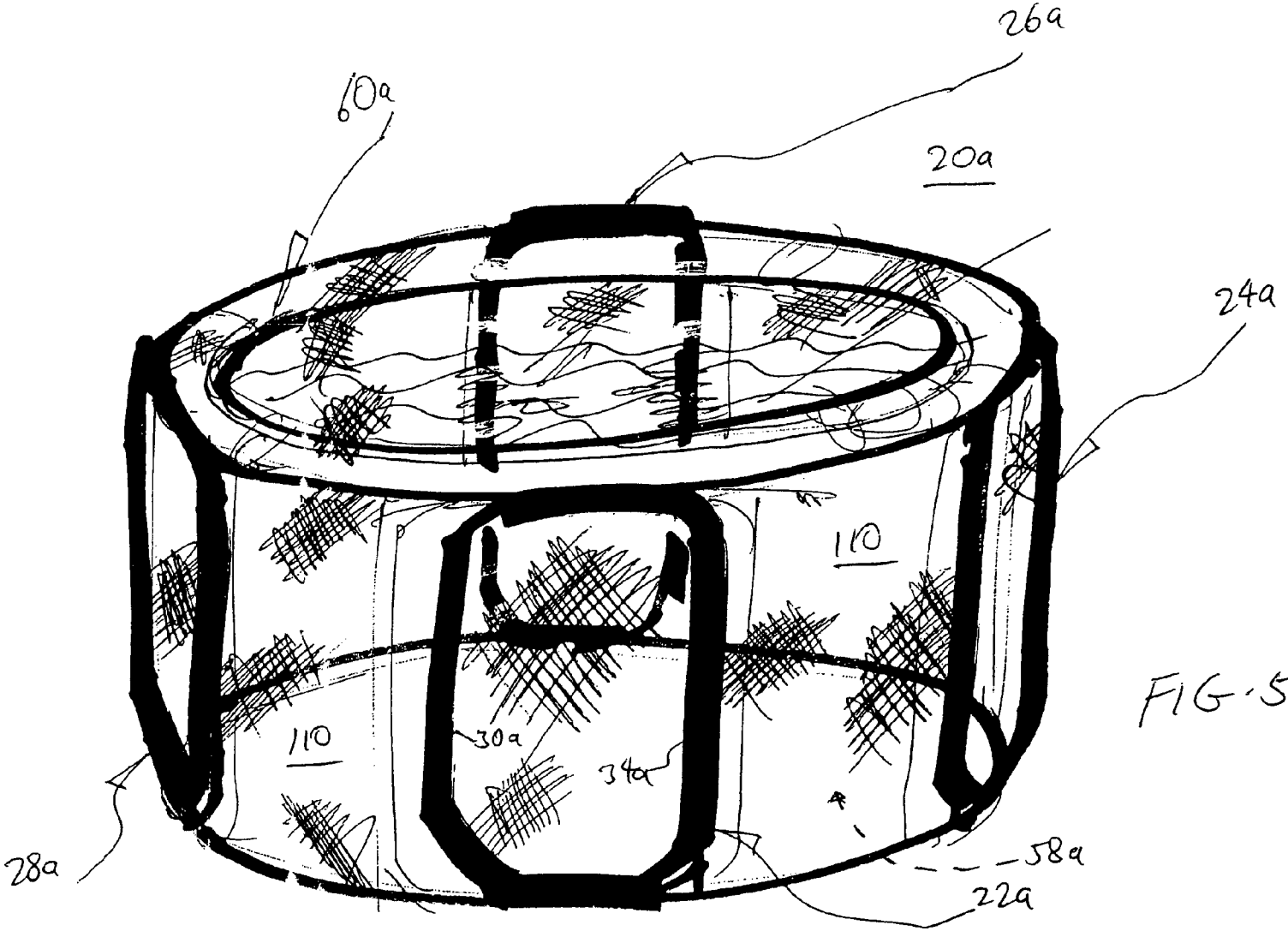

FIG. 5 illustrates a structure 20*a* having a similar configuration as the structure 20 in FIG. 1A. The structure 20*a* can also be used as a pool or container for holding water. As a result, the same numerals are used to designate the same elements in FIGS. 1A and 5, except that an "a" is added to the numerals in FIG. 5. In FIG. 5, the panels 22*a*, 24*a*, 26*a*, 28*a* are the same as the panels 22, 24, 26, 28, respectively, in FIG. 1A, except that connecting sheet material 110 is attached between the left side 30*a* of each panel and the right side 34*a* of each adjacent panel. The connecting sheet material 110 can function like the enclosing wall 96 in FIG. 4, and can be embodied in the form of a single sheet of material or can have two layers to define an inflatable chamber therewithin. In structure 20*a*, the connecting sheet material 110 functions as a hinge. In addition, the upper border 60*a* can be the same as the upper border 60, and embodied as a sleeve with a collapsible frame member, or as an inflatable tube.

The structure 20*a* can be collapsed in the same manner as the structure 20 using the steps illustrated above in connection with FIGS. 1A and 3A-3C. In particular, the first step consists of pushing in panels 22*a* and 24*a* about the hinges defined by the sheet material 110 such that panel 22*a* collapses upon panel 28*a*, and panel 24*a* collapses upon panel 26*a*. Then, in the second step, the two panels 24*a* and 26*a* are folded so as to be collapsed upon the two panels 22*a* and 28*a*. The resulting structure 20 is now a stack of four panels 28, 22, 24, 26 (in one possible order), which is then twisted and folded to collapse the frame members and panels into a smaller shape according to the principles illustrated in FIGS. 3A-3C. Each of the sheet material 110 can be tucked between two panels, and twisted and folded together with the panels.

Figure 6:
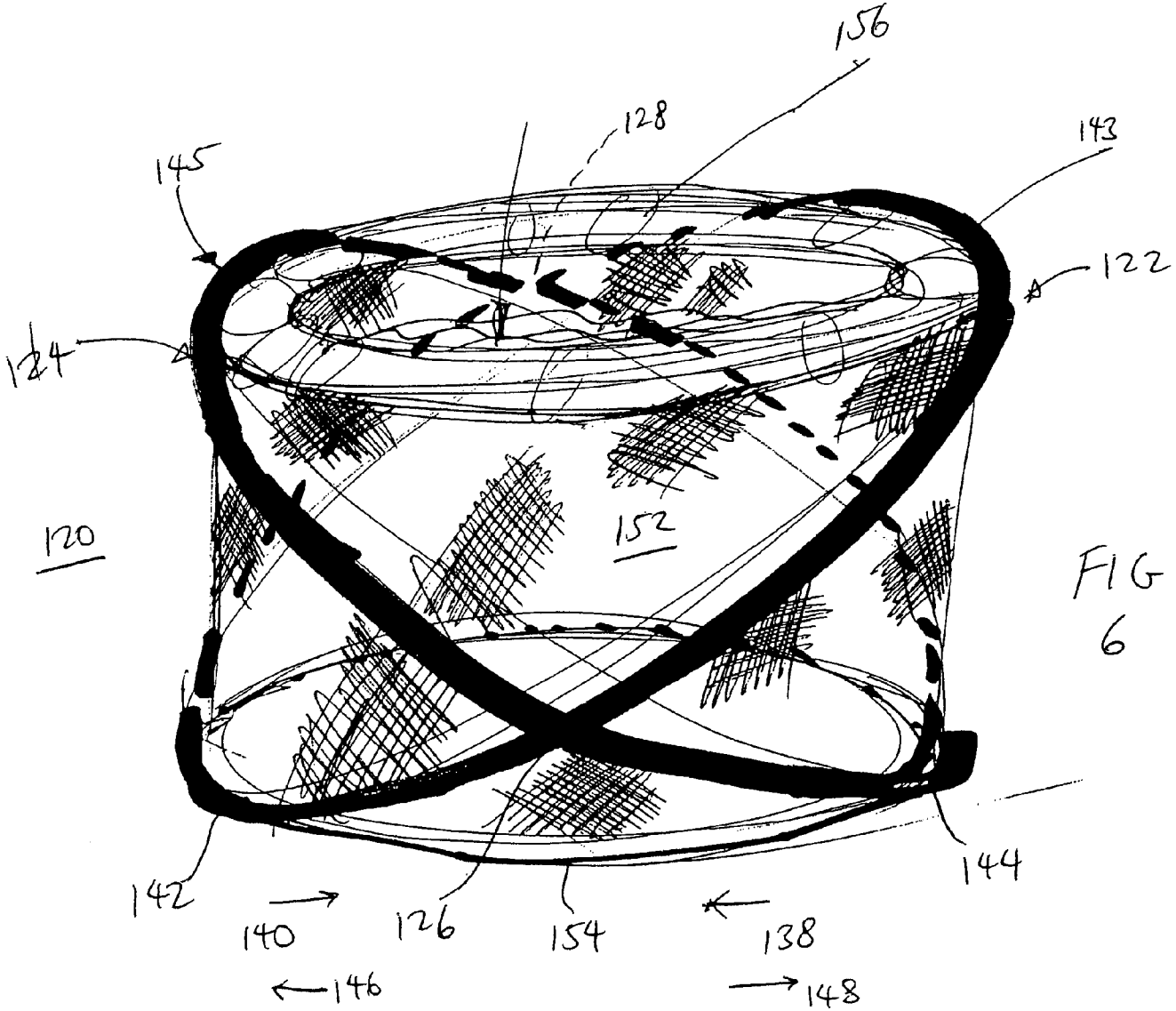

FIG. 6 illustrates another collapsible structure 120 according to the present invention that can also be used as a pool or container for holding water. The structure 120 has two overlapping or crossing collapsible frame members 122 and 124 that together define the outer boundaries of the walls of the structure 120. Referring to FIG. 6, each frame member 122 and 124 is provided as a closed resilient loop, either as a closed continuous loop or as a strip of material with both ends held together by a retaining connector or other conventional attachment mechanism to form a closed loop. Each frame member 122 and 124 is preferably formed of flexible coilable steel having a memory, and can be the same as the frame member 40 described above. Each frame member 122 and 124 can be substantially equal in size and symmetrically disposed, but it will be appreciated by those skilled in the art that the frame members 122 and 124 may assume any variety of shapes and sizes, including but not limited to circular, polygonal or oval. Both frame members 122 and 124 can even be provided in different sizes.

As illustrated in FIG. 6, the two frame members 122 and 124 overlap or cross-over each other at overlapping points 126 and 128. In one non-limiting embodiment, the left side of the first frame member 122 is interior to the left side of the second frame member 124, and the right side of the first frame member 122 is interior to the right side of the second frame member 124, so that the first frame member 122 is completely contained within the second frame member 124. The overlapping point 128 is defined by the intersection or crossing of the left sides of frame members 122 and 124, respectively, and the overlapping point 126 is defined by the intersection or crossing of the right sides of frame members 122 and 124, respectively. The overlapping points 126 and 128 can be positioned anywhere along the left and right sides of the frame members 122, 124, although they are shown as being positioned at about the center of the left and right sides in the structure 120 in FIG. 6. The two overlapping frame members 122 and 124 are pivotable about their overlapping points 126 and 128 between two positions, a first open position (see FIG. 6) in which both frame members 122 and 124 are disposed at an angle with respect to each other, and a second folded position in which the frame members 122 and 124 are folded towards each other (such as in the direction of arrows 138 and 140 in FIG. 6) to overlie each other in generally the same plane. When in the first open position, the bottom sides 142 and 144 of the frame members 122 and 124, respectively, are adapted to rest on a surface to form a supporting base for the structure 120. In contrast, when in the second folded position, the bottom sides 142 and 144 (and the top sides 143 and 145) of the frame members 122 and 124, respectively, are urged against each other.

The frame members 122 and 124 are not connected or attached at the overlapping points 26 and 28 so as to allow the frame members 122 and 124 to pivot about these points in the two directions illustrated by arrows 138+140 and 146+148 in FIG. 6, with the overlapping points 126 and 128 together acting as hinges when the frame members 122 and 124 are simultaneously pivoted about these points 126 and 128.

Each frame member 122 and 124 is retained in a separate frame retaining sleeve that extends around the entire frame member. Each frame retaining sleeve is stitched to a wall 152, which is described in greater detail hereinbelow. The construction of each sleeve, and how each sleeve is attached to the wall 152, are disclosed in greater detail in U.S. Pat. No. 6,092,544 to Zheng, whose disclosure is incorporated by this reference as though set forth fully herein. The frame members 122, 124 may be merely retained within the respective retaining sleeves without being connected thereto. Alternatively, the retaining sleeves may be mechanically fastened, stitched, fused, or glued to the respective frame members 122, 124 to retain them in position.

The structure 120 has an enclosing wall 152 and a bottom wall 154 that are supported by the frame members 122, 124 when the structure 120 is in the open position, to form an enclosed space for holding water or other matter. The walls 152, 154 can be made from a material similar to the sheet material 46 described above. An upper border 156 can be provided at the top of the structure 120 and attached to the top sides 143 and 145 of the frame members 122, 124, respectively. The border 156 can have the same construction as the border 60 described above. The border 156 defines at least one opening through which water or other matter can be introduced into the interior of the structure 120.

In one embodiment, the enclosing wall 152 can be generally circular or oval. Alternatively, the sleeves and their frame members 122, 124 can be attached (e.g., by stitching), to the surface of the wall 152 in a manner such that they define four separate vertical side walls for the enclosing wall 152, as disclosed in U.S. Pat. No. 6,092,544 to Zheng.

When the structure 120 is in its fully deployed configuration shown in FIG. 6, the enclosing wall 152 defines the limits to which the two frame members 122, 124 can be pivoted away from each other (i.e., pivoted in directions of arrows 146, 148).

The structure 120 can be folded and collapsed in the following manner. The first step consists of urging the two frame members 122 and 124 towards each other (as shown by arrows 138 and 140 in FIG. 6) about the hinging mechanism of the overlapping points 126, 128. The enclosing wall 152 collapses onto the frame members 122 and 124 as the frame members 122, 124 are urged against each other. When the two frame members 122 and 124 are urged together, the next step is to twist and fold the combined structure 120 in the manner illustrated in FIGS. 3A-3C.

To deploy the structure 120 back to the expanded, fully deployed position, the frame members 122 and 124 are unfolded. The resiliency and spring force of the frame members 122, 124 will cause the frame members 122, 124 to spring open to the expanded configuration. The frame members 122, 124 can then be pivoted about their hinged overlapping points 126, 128 to deploy the structure 120 to its original expanded configuration. When the frame members 122, 124 are fully deployed, the wall 152 can assume the configuration shown in FIG. 6.

Figure 7:
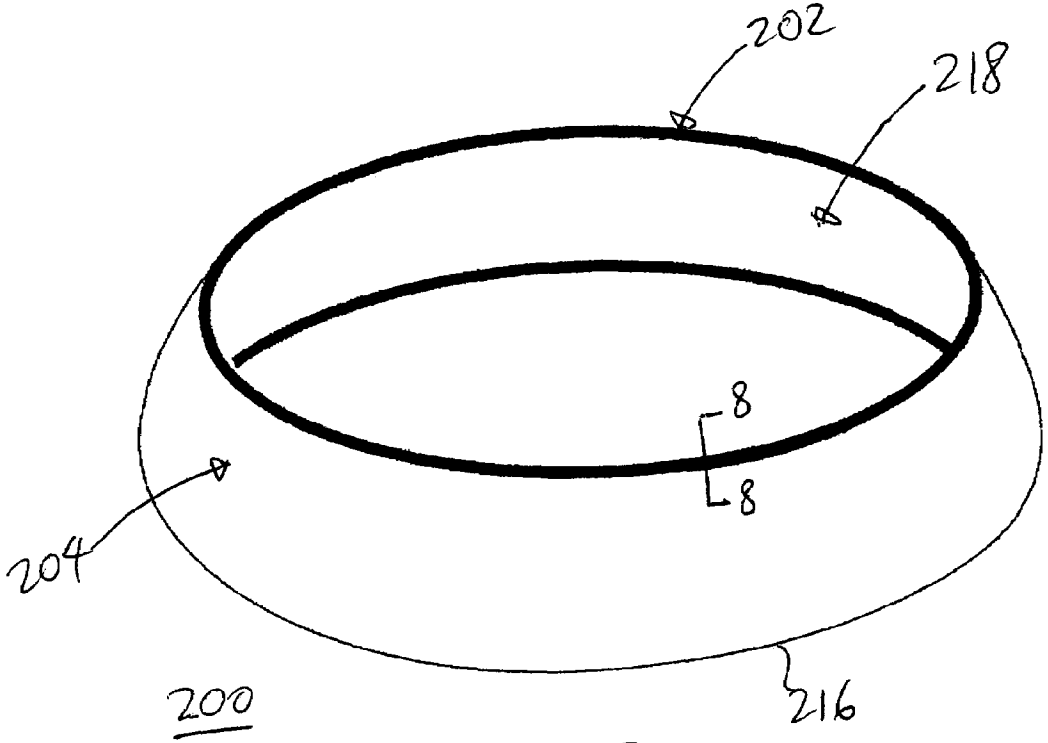

FIG. 7 illustrates yet another structure 200 according to the present invention. The structure 200 has a rim member 202 and a containing member 204. The rim member 202 defines a central opening 218, and includes a collapsible frame member 206 that can be the same as the frame member 40 described above.

Figure 8A:
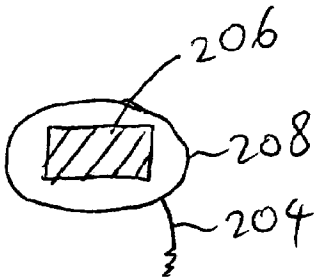
FIG. 8A is a cross-sectional view of one embodiment of the rim member of the structure of FIG. 7 taken along line 8-8 thereof.

Referring to FIG. 8A, the rim member 202 can be embodied with the frame member 206 retained inside a frame retaining sleeve 208. The sleeve 208 and frame member 206 can extend around the entire rim member 202. The sleeve 208 can have the same construction as the sleeve 38 described above, and the frame member 206 can be retained inside the sleeve 208 in the manner described above.

Figure 8B:
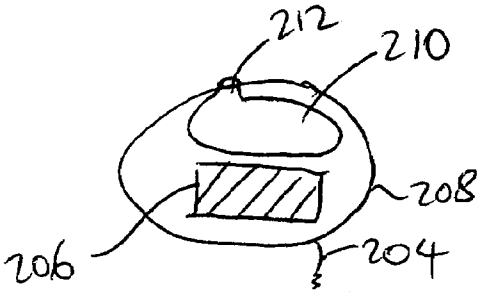
FIG. 8B is a cross-sectional view of another embodiment of the rim member of the structure of FIG. 7 taken along line 8-8 thereof.

Referring now to FIG. 8B, the rim member 202 can be the same as in FIG. 8A, except that one or more inflatable members 210 (e.g., an inflatable tube) can also be provided inside the sleeve 208 and extend around the entire rim member 202. An air inlet 212 can extend through the sleeve 208 to allow air to be introduced into the inflatable member 210.

In addition, a protective covering (which can be the same as protective covering 42) can be provided to cover the frame member 206. The protective covering can be effective in preventing the metallic frame member 206 from rust and damage due to possible exposure to water.

The containing member 204 can be embodied in the form of a flexible and waterproof sheet of material, such as PVC, plastic, polyethylene or other similar kinds of material. The material should be capable of being folded and crumpled when not in use. The sheet of material of the containing member 204 is attached (e.g., by stitching) to the rim member 202 to define an internal containing space. The material of the containing member 204 is sized and configured so that the containing member 204 has a base 216 that has a wider diameter than the diameter of the rim member 202 when the containing member 204 is stretched taut to its maximum limit (e.g., when the containing member 204 is filled with water), as shown in FIG. 7.

To use the structure 200 as a collapsible pool, the user merely places the structure 200 on the ground and introduces water through the central opening 218 of the rim member 202 into the containing space of the containing member 204. As the containing member 204 fills up with water, the rim member 202 rises up, and the base 216 of the containing member 204 begins to expand and assume a diameter that is wider than the diameter of the rim member 202. The flexible and waterproof nature of the material used for the containing member 204, as well as the sagging experienced by the annular side wall of the containing member 204, allow the containing member 204 to retain water (without spilling) while simultaneously conforming to the increasing volume of the water.

The embodiment of FIG. 8B provides one or more inflatable members 210 that can float on top of the water level of the water that is being introduced into the containing member 204, which further helps to maintain the water inside the containing member 204 without experiencing spillage thereof. The inflatable member 210 can be embodied as one continuous inflatable member 210 extending around the sleeve 208, or as a plurality of inflatable members 210 spaced apart inside the sleeve 208.

When the user wishes to store the structure 200, the user merely empties the water from the containing member 204, squeezes, folds or crumples the material of the containing member 204 against the rim member 202, and then twists and folds the frame member 206 in the same manner as shown in FIGS. 3A-3C to reduce the size of the structure 200.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure comprising:

an annular rim member defining a central opening, the rim member including a foldable frame member having a folded and an unfolded orientation, a sleeve that retains the frame member, and at least one inflatable member retained inside the sleeve; and a flexible and waterproof material attached to the rim member to form a containing member that defines a containing space therewithin, the containing member having a base that has a diameter that is greater than the diameter of the rim member when the containing space is filled with a liquid.

2. The structure of claim 1, wherein the frame member is folded into a plurality of concentric frame members when the frame member is in the folded orientation.

3. The structure of claim 1, wherein the material is PVC.

4. A collapsible structure comprising:

a rim member defining a central opening, the rim member including a foldable frame member having a folded and an unfolded orientation, a sleeve that retains the frame member, and at least one inflatable member retained inside the sleeve; and a flexible and waterproof material attached to the rim member to form a containing member that defines a containing space therewithin, the containing member having a base that has a diameter that is greater than the diameter of the rim member when the material is stretched taut.

5. The structure of claim 4, wherein the frame member is folded into a plurality of concentric frame members when the frame member is in the folded orientation.

6. The structure of claim 4, wherein the material is PVC.

* * * * *